US006850118B2

(12) United States Patent
Hanafusa et al.

(10) Patent No.: US 6,850,118 B2
(45) Date of Patent: Feb. 1, 2005

(54) AMPLIFIER CIRCUIT AND POWER SUPPLY PROVIDED THEREWITH

(75) Inventors: Koichi Hanafusa, Gojo (JP); Takao Kanzaki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 2 days.

(21) Appl. No.: 10/623,580

(22) Filed: Jul. 22, 2003

(65) Prior Publication Data

US 2004/0124925 A1 Jul. 1, 2004

(30) Foreign Application Priority Data

Oct. 31, 2002 (JP) ..... 2002-318975

(51) Int. Cl.[7] ..... H03F 3/04
(52) U.S. Cl. ..... 330/297; 330/257
(58) Field of Search ..... 330/127, 257, 330/292, 297

(56) References Cited

U.S. PATENT DOCUMENTS 5,859,757 A 1/1999 Hanafusa et al. ..... 361/100
6,559,626 B2 * 5/2003 Horie ..... 323/282
6,717,467 B2 * 4/2004 Renous et al. ..... 330/292

OTHER PUBLICATIONS

Kazuo Watanabe, "Designing of Practical Analog Electronic Circuits", Sougou–Denshi Shuppansha, Jun. 22, 1996, pp. 109–112.

* cited by examiner

*Primary Examiner*—Khanh V. Nguyen
(74) *Attorney, Agent, or Firm*—Harness, Dickey & Pierce P.L.C.

(57) ABSTRACT

An amplifier circuit includes first and second resistors that are serially connected to each other between bases of first and second transistors that flow the same current as that in a differential transistor pair made up of two transistors. A capacitor is provided between a junction of the first and second resistors and the collector of the first transistor on the output side. The amplifier circuit has a gain whose frequency characteristic is determined by a low-pass filter realized by the second resistor and capacitor connected to the second transistor. The frequency characteristic lowers a gain of the frequency that causes output oscillation, thereby preventing output oscillation. The two resistors divide a resistance between the bases of the sub transistors, so as to reduce a resistance of the second resistor. As a result, the effect of phase compensation becomes weaker and the load response characteristic of the power supply improves. This enables the DC regulated power supply, even if it is of an intermediate current type which produces an output current of about 500 mA, to prevent output oscillation without reducing the load response characteristic, even when a chip-stacked ceramic capacitor is used as the output capacitor.

14 Claims, 9 Drawing Sheets

AMPLIFIER CIRCUIT AND POWER SUPPLY PROVIDED THEREWITH

FIELD OF THE INVENTION

The present invention relates to an amplifier circuit as an error amplifier for use in a DC regulated power supply, and to a power supply provided with such an amplifier circuit.

BACKGROUND OF THE INVENTION

FIG. 6 represents an equivalent circuit of a conventional DC regulated power supply.

The power supply receives input voltage Vi and outputs it as output voltage Vo via a PNP-type output transistor Q10. In addition, the power supply supplies current Io to a load RL according to a base current that flows into a driver 11 from the output transistor Q10. The output voltage Vo is divided by a voltage divider made up of serially connected voltage dividing resistors RA and RB, and supplied to an error amplifier 12 as a feedback voltage Vadj. The error amplifier 12 also receives a constant reference voltage Vref generated by a reference voltage source 13. The error amplifier 12 amplifies a difference between the feedback voltage Vadj and the reference voltage Vref and outputs a control voltage. Based on the control voltage, the driver 11 controls the base current of the output transistor Q10, so as to regulate the output voltage Vo. In this way, the power supply is able to apply output voltage Vo of a constant level to the load RL, regardless of fluctuations in input voltage Vi or load current.

FIG. 7 represents a circuit diagram of the error amplifier 12. The error amplifier 12 includes transistors Q15 and Q16 that make up a differential pair. The base of the transistor Q15 is a non-inverted input terminal IN+ that receives reference voltage Vref. The base of the transistor Q16 is an inverted input terminal IN− that receives feedback voltage Vadj. In the error amplifier 12, a change in feedback voltage Vadj causes a change in emitter current of the transistor Q16. In order to provide a constant current flow, a constant current source CS11 varies the emitter potentials of the transistors Q15 and Q16, so that the emitter current of the transistor Q15 varies inversely with the emitter current of the transistor Q16. In response, a control voltage Vc, which is extracted from a transistor Q11 on the side of the transistor Q15, is also varied.

For the purpose of preventing output oscillation, DC regulated power supplies such as above generally include a capacitor Co between the output terminal of the power supply and GND. The capacitor Co is serially connected to a resistor ESR, which is a serial equivalent resistor of the capacitor Co.

In a structure where the error amplifier 12 is included in a feedback loop as in the foregoing power supply, a phase shift is generated between the input and output voltages of the error amplifier 12, causing the error amplifier 12 to oscillate. On way to solve such an oscillation is to provide a phase compensation circuit made up of a capacitor C11 and a resistor R12, as shown in FIG. 7 for example. The following describes the phase compensation circuit in detail.

In the error amplifier 12, the same current flows through transistors Q11 and Q12 that make up a current mirror circuit. Similarly, the same current flows through transistors Q13 and Q14 that make up a current mirror circuit. A transistor Q17 is serially connected to the transistor Q11, and the capacitor C11 is connected between the base and collector of the transistor Q17. A transistor Q18 is serially connected to the transistor Q14, and the base and collector of the transistor Q18 is connected to each other. The bases of the transistors Q17 and Q18 are connected to each other via a resistor R11.

When the transistors Q17 and Q18 are turned on, a low-pass filter (phase compensation circuit) realized by the capacitor C11 and resistor R11 is connected to the error amplifier 12. The phase compensation constant of the phase compensation circuit is determined by the time constant C×R, where C is the capacitance of the capacitor C11, and R is the resistance of the resistor R11. The larger the phase compensation constant, the stronger the effect of phase compensation. The frequency characteristic of the error amplifier 12 is determined from a cut-off frequency of the low-pass filter, which is expressed as $$fo=1/2\pi(Av\times C)R$$

where Av is the voltage gain of the error amplifier 12.

The provision of the low-pass filter in the error amplifier 12 prevents oscillation because it lowers a gain in a high-frequency range (approximately 3 dB) that causes oscillation.

One conventional example of phase compensation by error amplifier is Japanese Publication for Unexamined Patent Application No. 111722/1998 (Tokukaihei 10-111722; published on Apr. 28, 1998) (corresponding U.S. Pat. No. 5,859,757), which discloses a power supply with an error amplifier that is connected to an external phase compensation capacitor.

In small-package DC regulated power supplies with a small current output (output current Io≦200 mA) for use in portable phones or other portable devices, there has been demand for externally providing a capacitor of a small capacitance and using such capacitor as an output capacitor, so that the mount area for the power supply in the device can be reduced. Such demand has encouraged development of many types of small-current-output DC regulated power supplies that allow the use of ceramic capacitor for the output capacitor. These DC regulated power supplies have been put to actual applications.

Meanwhile, many desktop apparatuses such as CD-ROM apparatuses and DVD-ROM apparatuses use a DC regulated power supply of an intermediate current range (generally from 300 mA to 500 mA). Miniaturization (both size and thickness) of these apparatuses has created demand for high-density packaging of the apparatus components (including power supply). Therefore, the market demand for externally providing a ceramic capacitor as the output capacitor to reduce the mount area in the apparatus has also been strong in the DC regulated power supplies that produce an intermediate output current of about 500 mA.

The size and thickness of the apparatus can be desirably reduced when the output capacitor is realized by a chip-stacked ceramic capacitor, which has a relatively large capacitance for its small size. FIG. 8 represents an equivalent circuit of such a chip-stacked ceramic capacitor.

The large capacitance of the chip-stacked ceramic capacitor is realized by the stacked structure of dielectric. The ceramic capacitor is an electrical equivalent of a circuit in which individual capacitors CI1 through CIn are connected to one another in parallel. When each capacitance of the capacitors CI1 through CIn is C0, the total capacitance of the ceramic capacitor is n×C0. The respective series equivalent resistors ESR1 through ESRn of the capacitors CI0 through CIn are also provided in parallel. Thus, when each resistance of the series equivalent resistors ESR1 through ESRn is R0, the series equivalent resistance of the chip-stacked ceramic capacitor is given by n×R0.

However, owning to such a structure, the series equivalent resistance of the chip-stacked ceramic capacitor is relatively low as compared with other types of capacitors, such as a tantalum capacitor or an A1 electrolytic capacitor. Accordingly, the output phase of the power supply using the chip-stacked ceramic capacitor tends to run fast, making the power supply susceptible to output oscillation.

The susceptibility to output oscillation is even more prominent in an intermediate-current power supply with an output current of about 500 mA, because it produces a larger output current than the small-current power supply and the output impedance of the output transistor is accordingly smaller. For example, a required capacitance of the output capacitor is about 10 $\mu$F in the intermediate-current power supply, compared with 2.2 $\mu$F for the capacitor used in the small-output power supply. Despite the large capacitance it provides, the use of chip-stacked ceramic capacitor as the output capacitor is therefore not suitable for actual applications due to its susceptibility to output oscillation.

FIG. 9 is a graph representing a relationship between output current and output noise level of power supplies. The graph plots output noise level characteristics of a small-current power supply (150 mA) and an intermediate-current power supply (500 mA), which are respectively indicated by solid line and broken line, when the capacitance of the output capacitor is held at a constant level (1.0 $\mu$F). Note that, the graph uses the logarithm scale.

It can be seen from the graph that the output noise level of the small-current power supply increases abruptly, i.e., output oscillation is generated, when the output current falls below about 5 mA. In contrast, in the intermediate-current power supply, the output noise level increases abruptly (output oscillation is generated) when the output current exceeds about 200 mA. The intermediate-current power supply operates on an intermediate current range (200 mA to 500 mA), which falls outside of the current range for the small-current power supply. In the intermediate current range, oscillation is caused when the phase margin of the output section is reduced by the reduced output impedance of the output transistor.

In order to solve this problem, the DC regulated power supply enhances the effect of phase compensation in the error amplifier, so that output oscillation can be prevented. However, with the strong phase compensation, response characteristics suffer, and particularly the response of the output section becomes poor when there is an abrupt output current increase. FIG. 10 represents such output response ("load response characteristic" hereinafter).

It can be seen from the graph that the output voltage Vo of the conventional DC regulated power supply instantaneously drops to about 0.5V in response to a load fluctuation, as indicated by solid line, before it levels off to a constant level slightly below the original value prior to the load fluctuation. When the rated output voltage is 3.3V, the decrement of the instantaneous voltage drop should preferably be about 3% of the rated output voltage, i.e., about 0.1V. However, due to the poor output characteristic, it has been difficult with the conventional DC regulated power supply to achieve such a small value.

SUMMARY OF THE INVENTION

An object of the present invention is to provide a DC regulated power supply having a superior load response characteristic, and to provide an amplifier circuit suitable for such a power supply, with which output oscillation can be prevented even when the DC regulated power supply is of an intermediate current type which produces an output current of about 500 mA, and when a chip-stacked ceramic capacitor is used as the output capacitor.

In order to achieve the foregoing object, an amplifier circuit of the present invention includes: a comparing and amplifying section that compares a target voltage and a reference voltage and amplifies a difference of the target voltage and the reference voltage; and a phase compensator that compensates for a shift of input and output phases. The phase compensator includes two resistors and a capacitor, the two resistors being serially connected between bases of two sub transistors that flow the same current as that in a differential transistor pair made up of two transistors, the capacitor having a terminal connected to an output terminal of the amplifier circuit, and the capacitor having a terminal connected via one of the two resistors to the base of one of the two sub transistors receiving an amplifier output voltage outputted from the output terminal.

With this configuration, when the two sub transistors are turned on, the amplifier circuit is connected to a low-pass filter that is realized by the resistor and capacitor connected to the base of the other sub transistor of the sub transistor disposed on the output terminal side of the amplifier circuit. The amplifier circuit has a gain whose frequency characteristic is decided by the cut-off frequency of the low-pass filter. Therefore, output oscillation can be prevented by lowering a gain of the frequency that causes output oscillation. Further, the two resistors divide a resistance between the bases of the sub transistors, reducing the resistance of the resistor making up the low-pass filter. This decreases the value of phase compensation constant that is determined by the product of capacitance and resistance of the capacitor and resistor making up the low-pass filter. As a result, the effect of phase compensation becomes weaker, making it possible to carry out phase compensation without causing a spontaneous voltage drop of output voltage in response to an abrupt load fluctuation.

The amplifier circuit is therefore able to prevent output oscillation and improve load response characteristic when used in the DC regulated power supply of an intermediate current type that uses a chip-stacked ceramic capacitor as the output capacitor.

A power supply of the present invention includes the amplifier circuit as an error amplifier, wherein the error amplifier controls an output voltage according to the difference of a feedback voltage and a reference voltage, the feedback voltage being a feedback output voltage of an output transistor. The present invention therefore provides a power supply in which output oscillation is prevented and load response characteristic is improved by the amplifier circuit.

For a fuller understanding of the nature and advantages of the invention, reference should be made to the ensuing detailed description taken in conjunction with the accompanying drawings.

DESCRIPTION OF THE EMBODIMENTS

The following describes one embodiment of the present invention with reference to FIG. 1 through FIG. 5.

Figure 1:
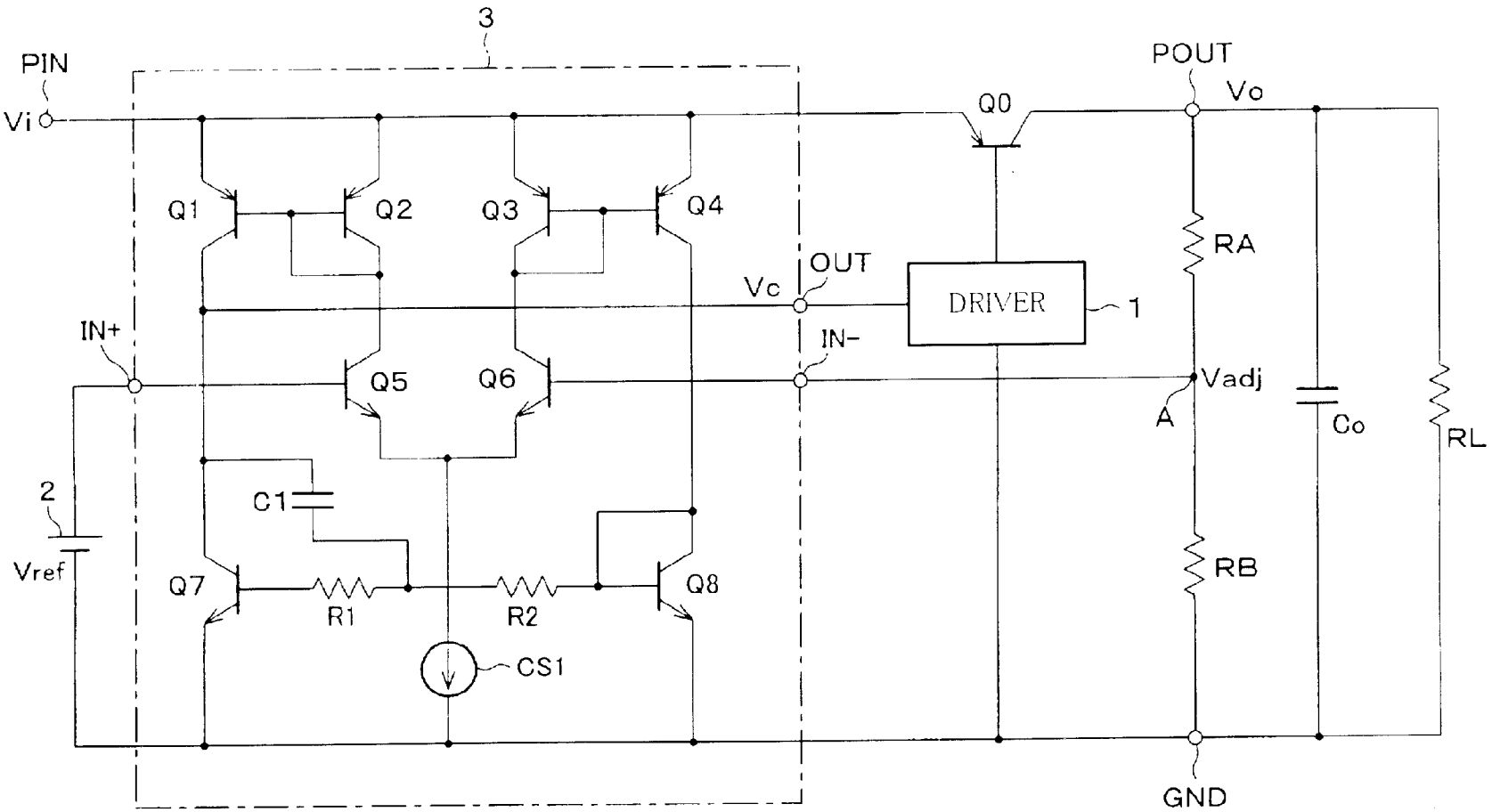
FIG. 1 is a circuit diagram representing a schematic structure of a first DC regulated power supply according to one embodiment of the present invention.

FIG. 1 is a circuit diagram representing a structure of a first DC regulated power supply (simply "power supply" hereinafter) according to the present embodiment.

The power supply includes a driver 1, a reference voltage source 2, an error amplifier 3, an output transistor Q0, voltage dividing resistors RA and RB, and an output capacitor Co.

The output transistor Q0 is of a PNP type and is provided as an output control transistor. The base of the transistor Q0 is connected to a driver output terminal of the driver 1, and the emitter and collector of the transistor Q0 are connected to an input terminal PIN and an output terminal POUT, respectively. The input terminal PIN receives an input voltage Vi, and the output terminal POUT outputs an output voltage Vo.

The voltage dividing resistors RA, RB, and the output capacitor Co are connected in parallel between the output terminal POUT and a ground terminal GND. The voltage dividing resistors RA and RB are serially connected to each other to make up a voltage divider. A junction A of the voltage dividing resistors RA and RB is connected to an inverted input terminal IN− of the error amplifier 3. The output capacitor Co is externally provided for preventing output oscillation, and is realized by a chip-stacked ceramic capacitor or other types of capacitors.

The reference voltage source 2 is provided between the input terminal PIN and the ground terminal GND. The reference voltage source 2 is a circuit or the like that generates reference voltage Vref of a constant level. For the reference voltage source 2, a constant voltage element such as a Zener diode, or a constant current circuit is used, for example. Further, the reference voltage source 2 is connected to a non-inverted input terminal IN+ of the error amplifier 3, so as to supply a generated constant voltage the error amplifier 3.

The error amplifier 3, which is an amplifier circuit, receives the input voltage Vi as a power voltage. The error amplifier 3 outputs a control voltage Vc (amplifier output voltage) for the driver 1 from an output terminal OUT, so as to match a feedback voltage Vadj (target voltage), which is produced (at the junction A) at a voltage ratio of the voltage dividing resistors RA and RB, and the reference voltage Vref produced in the reference voltage source 2.

The driver 1, including active elements and other circuit elements, is a circuit for driving the transistor Q0. The driver 1 controls the base current of the transistor Q0 based on the control voltage Vc from the error amplifier 3, so as to control the collector voltage of the transistor Q0, i.e., the output voltage Vo.

The following describes the error amplifier 3.

The error amplifier 3 includes PNP-type transistors Q1 through Q4, NPN-type transistors Q5 through Q8, a capacitor C1, and resistors R1 and R2.

The transistors Q5 and Q6 make up a differential transistor pair. The base of the transistor Q5 is connected to the non-inverted input terminal IN+, and the base of the transistor Q6 is connected to the inverted input terminal IN−. The emitters of the transistors Q5 and Q6 are connected to one terminal of a constant current source CS1, and the other terminal of the constant current source CS1 is connected to the ground terminal GND. The collectors of the transistors Q5 and Q6 are respectively connected to the collectors of the transistors Q2 and Q3. A circuit portion realized by the transistors Q5, Q6, and the constant current source CS1 serves as a comparing and amplifying section that compares the feedback voltage Vadj and the reference voltage Vref and amplifies the difference of the two voltages.

The base and collector of the transistor Q2 are connected to each other. The base of the transistor Q2 is also connected to the base of the transistor Q1. The collector of the transistor Q1 is connected to the output terminal OUT and to the collector of the transistor Q7 (sub transistor). The base and collector of the transistor Q3 are connected to each other. The base of the transistor Q3 is also connected to the base of the transistor Q4. The emitters of the transistors Q1 through Q4 all receive the input voltage Vi as a power voltage from the input terminal PIN.

The base of the transistor Q7 is connected to the base of the transistor Q8 (sub transistor) via the serially connected resistors R1 and R2. The collector and base of the transistor Q8 are connected to each other. The collector of the transistor Q8 is also connected to the collector of the transistor Q4. The capacitor C1 is connected between the collector of the transistor Q7 (i.e., output terminal OUT) and the junction of the resistors R1 and R2. In other words, the capacitor C1 is connected to the base of the transistor Q7 via the resistor R1. The emitters of the transistors Q7 and Q8 are connected to the ground terminal. A circuit realized by the resistors R1, R2, and the capacitor C1 makes up a phase compensation circuit (phase compensator). The base of the transistor Q7, by being connected to the resistor R1, has higher impedance with respect to the junction of the resistors R1 and R2.

A circuit realized by the transistors Q1 and Q2 make up a current mirror circuit, so that the same current is flown through the transistors Q1 and Q2 as through the transistors Q7 and Q5. Likewise, a circuit realized by the transistors Q3 and Q4 makes up a current mirror circuit, so that the same current is flown through the transistors Q3 and Q4 as through the transistors Q6 and Q8.

The following describes operations of the power supply having the described structure.

With the input of input voltage Vi to the power supply, the transistor Q0 is turned on by being biased by the error amplifier 3 and the driver 1. Here, the output voltage Vo that appears at the collector of the transistor Q0 is divided by the voltage dividing resistors RA and RB. As a result, the feedback voltage Vadj, which is proportional to the output voltage Vo, is generated at the junction of the voltage dividing resistors RA and RB.

The feedback voltage Vadj is supplied to the inverted input terminal IN— of the error amplifier 3. The reference voltage Vref produced by the reference voltage source 2 is supplied to the non-inverted input terminal IN+ of the error amplifier 3. In response, the error amplifier 3 outputs the control voltage Vc according to the difference of the feedback voltage Vadj and the reference voltage Vref. Based on the control voltage Vc, the driver 1 controls the base current of the transistor Q0. By thus controlled by the transistor Q0, the output voltage Vo applied to the load RL is maintained at a constant level that is determined by the voltage ratio of the voltage dividing resistors RA, RB, and the reference voltage Vref.

In the error amplifier 3, a change in feedback voltage Vadj brings about a proportional change in emitter current of the transistor Q6. In order to maintain a constant current level, the constant current source CS1 varies the emitter currents of the transistors Q5 and Q6, so that the emitter current of the transistor Q5 varies inversely with the emitter current of the transistor Q6. Accordingly, the control voltage Vc, which is extracted from the collector of the transistor Q1 (output terminal OUT) on the side of the transistor Q5, is also varied. The control voltage Vc is supplied to the transistor Q7.

When the transistors Q7 and Q8 are turned on, the low-pass filter realized by the capacitor C1 and the resistor R2 is connected to the error amplifier 3. A phase compensation circuit, including the low-pass filter, has a phase compensation constant that is determined by the time constant $C_1 \times R_2$, where $C_1$ is the capacitance of the capacitor C1, and $R_2$ is the resistance of the resistor R2. The larger the phase compensation constant, the stronger the effect of phase compensation. The error amplifier 3 has a gain whose frequency characteristic is determined by the cut-off frequency of the low-pass filter, which is given by $$fo=1/2\pi(Av\times C_1)R_2$$

where Av is the voltage gain of the error amplifier 3.

Figure 7:
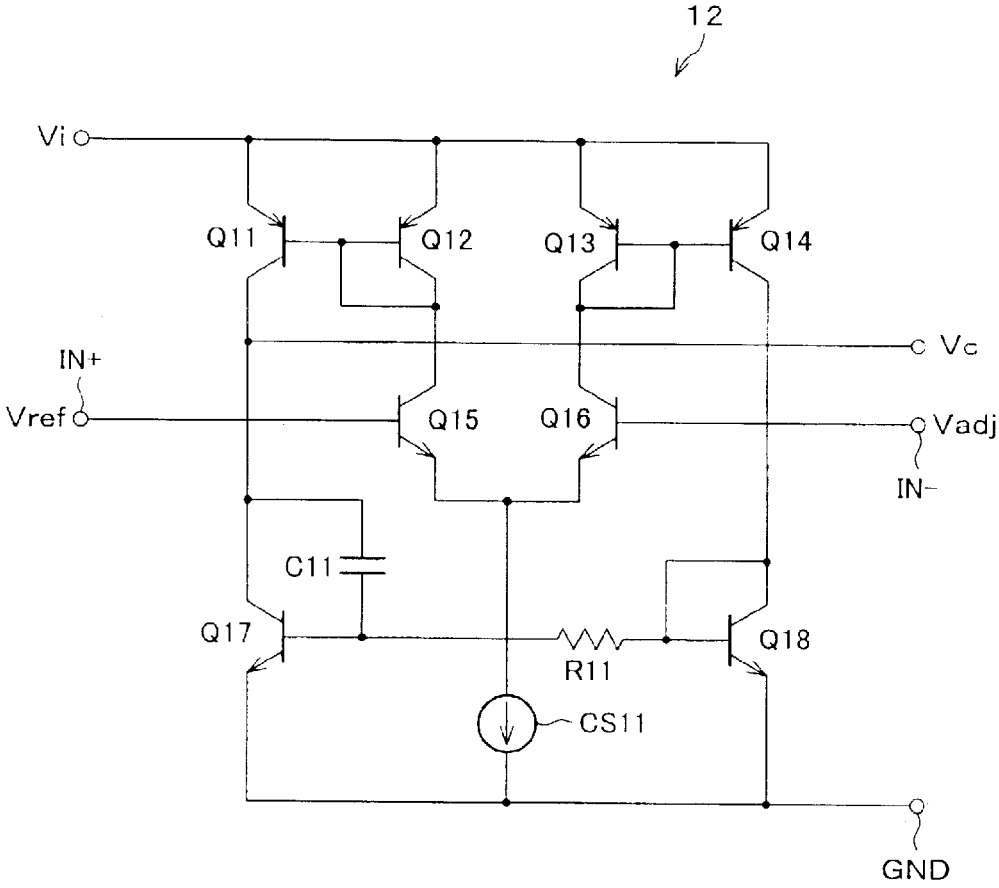
FIG. 7 (PRIOR ART)
FIG. 7 is a circuit diagram representing a schematic structure of an error amplifier provided in the DC regulated power supply.
Figure 8:
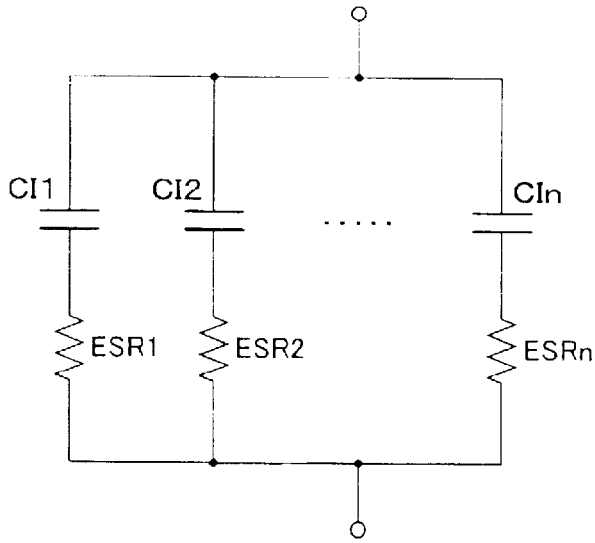
FIG. 8 is a circuit diagram representing an equivalent circuit of a chip-stacked ceramic capacitor provided as an output capacitor of the DC regulated power supply.
Figure 9:
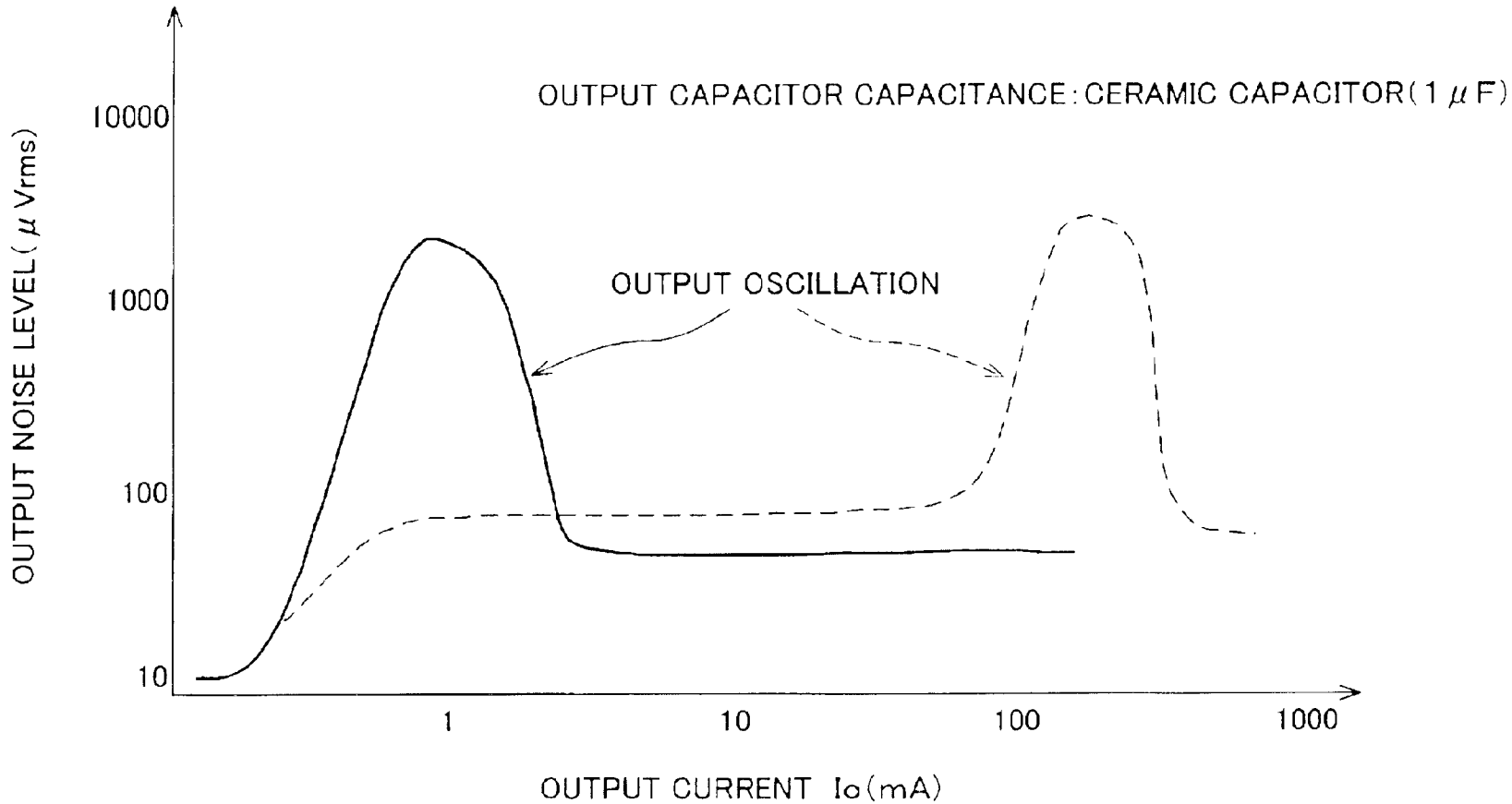
FIG. 9 is a graph representing a relationship between output current and output noise level in conventional power supplies of a small current type and of an intermediate current type.

The provision of the low-pass filter in the error amplifier 3 prevents oscillation because it lowers a gain in a high-frequency range that causes oscillation. In addition, in the error amplifier 3, the resistors R1 and R2 divide the resistance R of the resistor R11 in the error amplifier 12 of FIG. 7 described in connection with the BACKGROUND OF THE INVENTION section, so that the resistance $R_2$ is smaller than resistance R. The capacitance $C_1$ has the same capacitance (capacitance C) as the capacitor C11 of the error amplifier 12. Thus, in the error amplifier 3, the phase compensation constant $C_1 \times R_2$ is smaller than the phase compensation constant C×R of the error amplifier 12. This increases fo and as a result the effect of phase compensation is weaker than that in the error amplifier 12.

Figure 10:
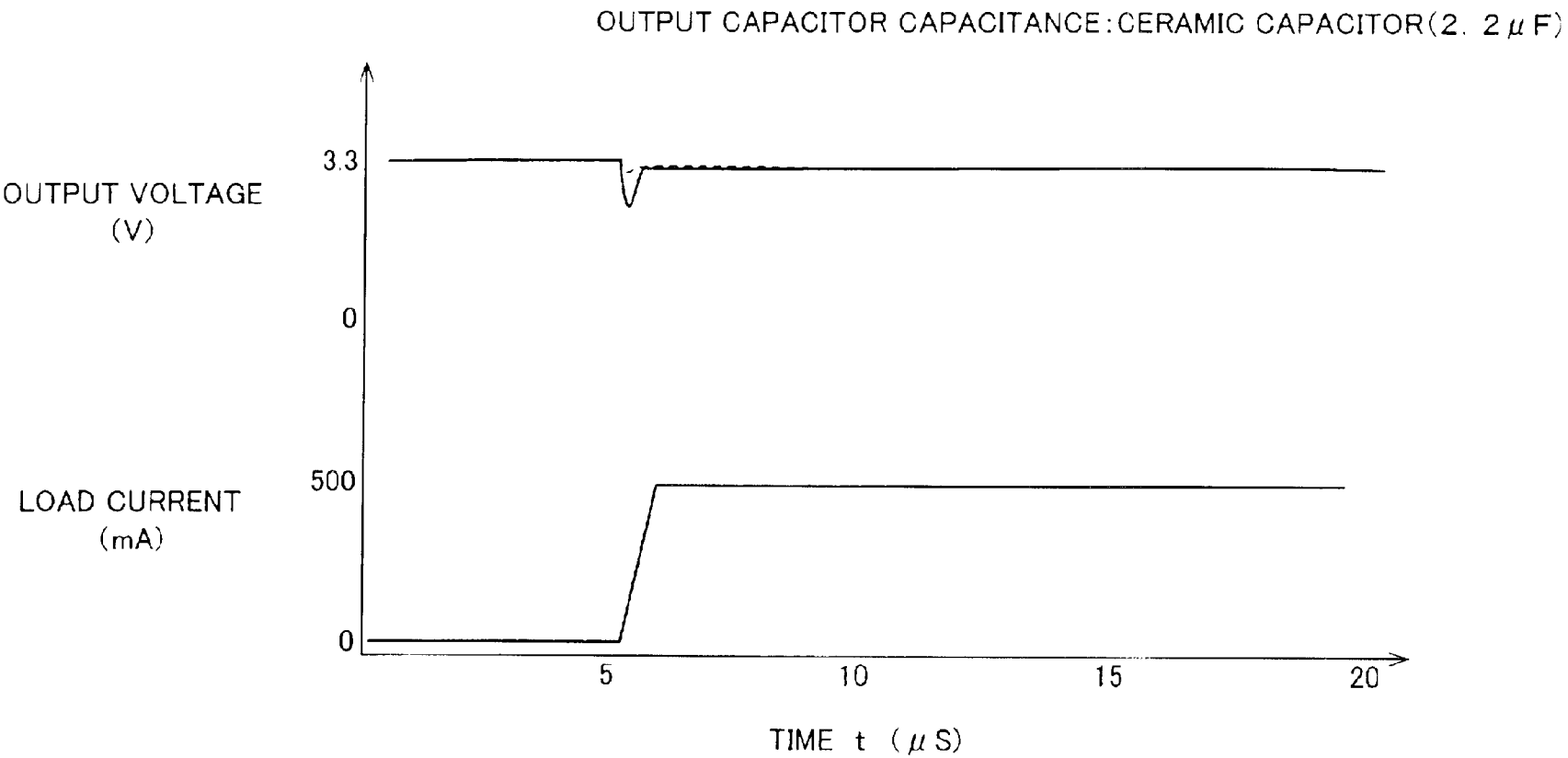
FIG. 10 is a graph representing output response characteristic when there is an abrupt increase in the conventional DC regulated power supply and in the DC regulated power supply of the present invention.

The error amplifier 3 therefore has an improved load response characteristic over the error amplifier 12 of the conventional example. This is indicated by broken line in FIG. 10, in which a spontaneous voltage drop of the output voltage Vo in response to an abrupt change in load current (output current Io) is suppressed not to exceed about 0.1V (approximately 3% of the rated output voltage of 3.3V). This enables the chip-stacked ceramic capacitor of a small capacitance to be used as the output capacitor Co, so that the load response characteristic can be improved without causing output oscillation.

Figure 2:
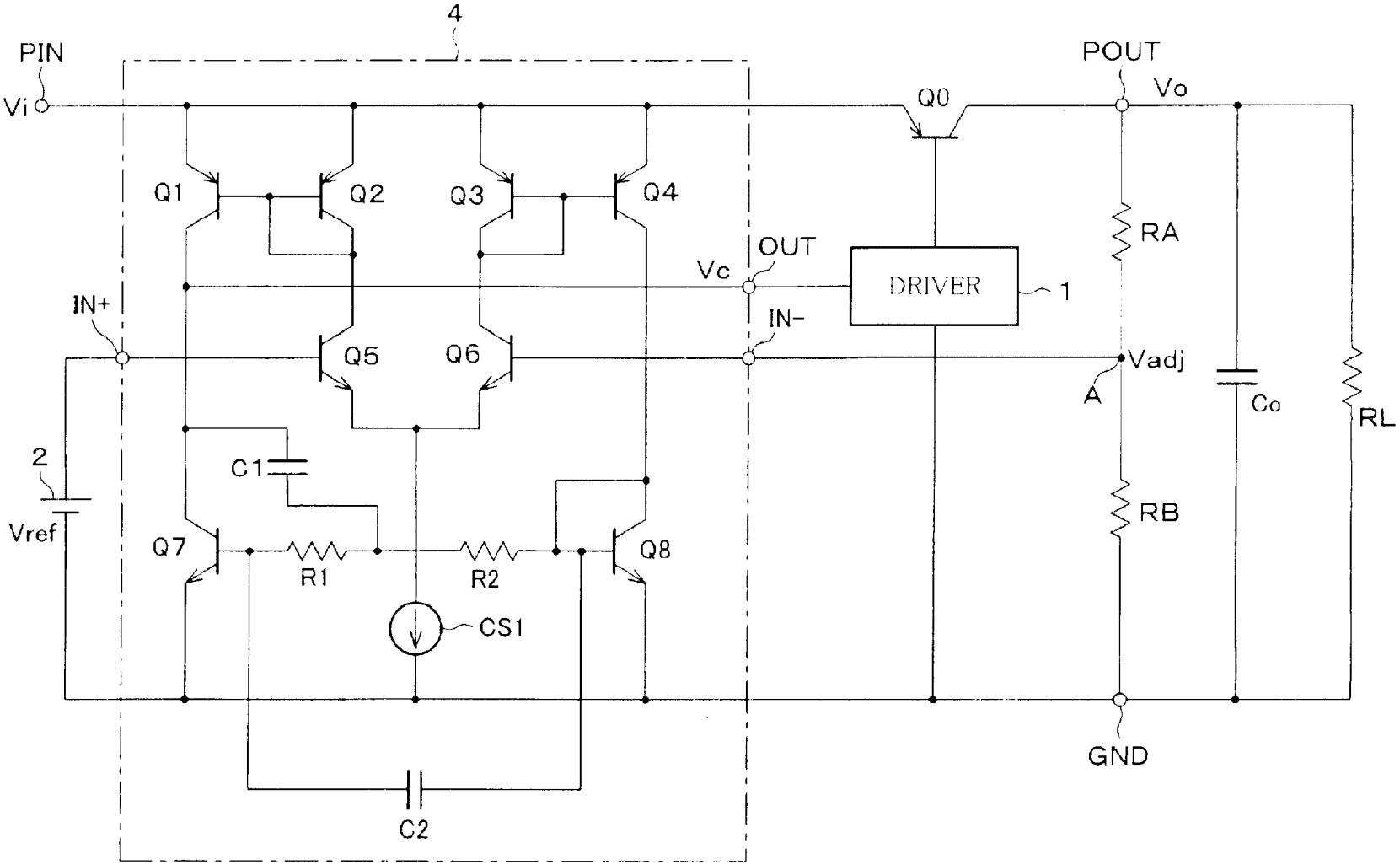
FIG. 2 is a circuit diagram representing a schematic structure of a second DC regulated power supply according to the embodiment of the present invention.

The following describes a second power supply according to the present embodiment. FIG. 2 shows a schematic structure of the power supply.

The power supply includes an error amplifier 4 in place of the error amplifier 3. In addition to the circuit elements of the error amplifier 3, the error amplifier 4 includes a phase compensation capacitor C2 (phase advancing capacitor) for compensating for an output phase delay. The terminals of the capacitor C2 are connected between the bases of the transistors Q7 and Q8, and the capacitor C2 is connected in parallel to the resistors R1 and R2. The capacitor C2 is realized by a ceramic capacitor, for example.

In the error amplifier 4, the capacitor C2 advances an output phase in the vicinity of 500 kHz, so as to lower the gain of the error amplifier 4 at this frequency. Further, by the provision of the capacitor C2, a change in voltage level of the input voltage to the inverted input terminal IN−, i.e., a change in feedback voltage Vadj is more quickly transmitted to the transistor Q7 via transistors Q6, Q3, Q4, Q8 and capacitor C2, turning on the transistor Q7 more quickly. This enables the phase compensation operation of the phase compensation circuit to more quickly respond to an abrupt change in voltage level of the input voltage to the inverted input terminal IN−, i.e., the output voltage Vo, making it possible to prevent output oscillation more reliably. As a result, fast response is realized in the error amplifier 4.

In contrast, in the error amplifier 3, the absence of the capacitor C2 causes an abrupt change in voltage level of the input voltage to the inverted input terminal IN− to be transmitted to the transistor Q7 via transistors Q6, Q3, Q4, Q8, and resistors R1 and R2. Thus, the ON timing of transistor Q7 is slower in the error amplifier 3 than the error amplifier 4.

Figure 3:
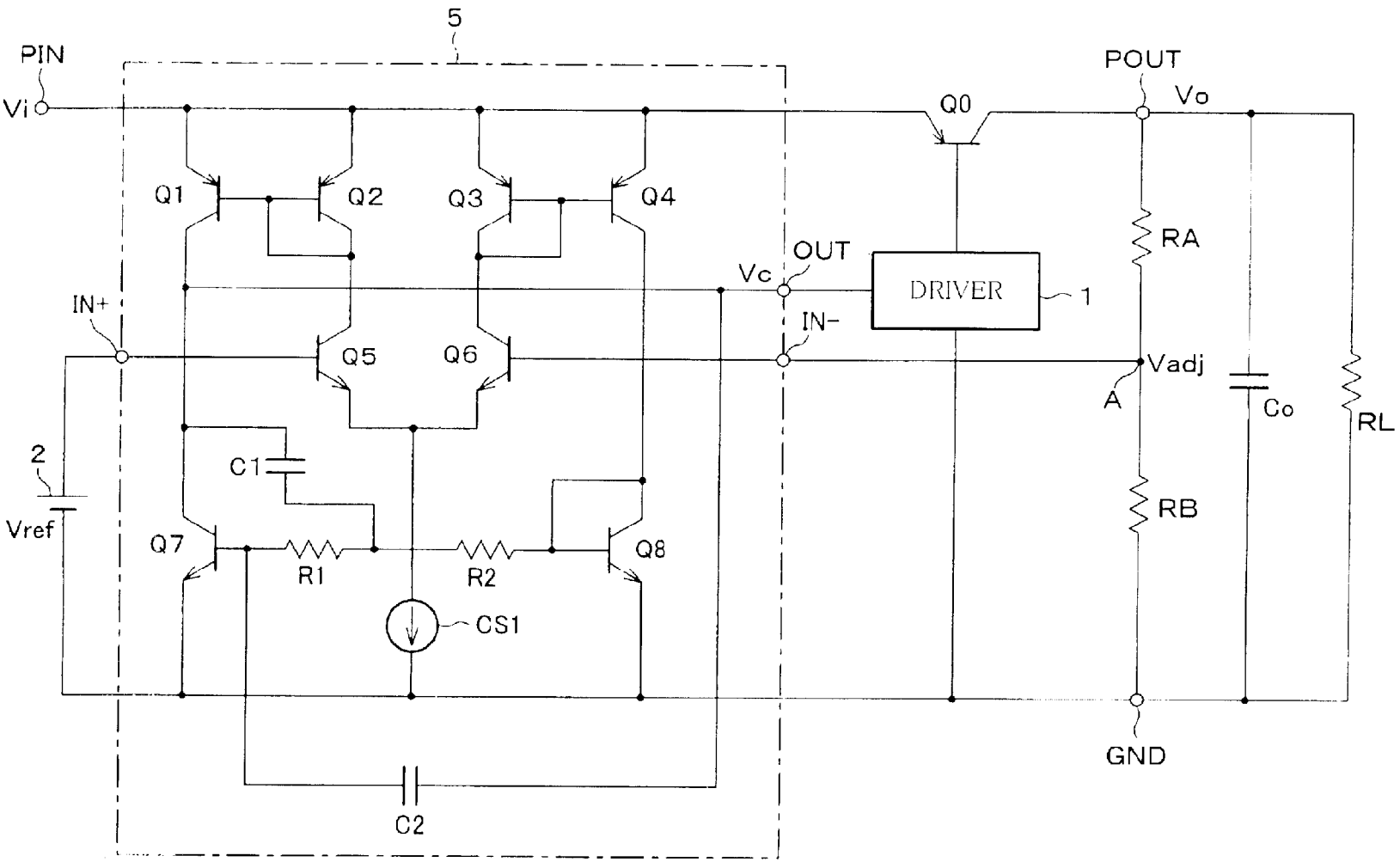
FIG. 3 is a circuit diagram representing a schematic structure of a third DC regulated power supply according to the embodiment of the present invention.

The following describes a third power supply according to the present embodiment. FIG. 3 shows a schematic structure of the power supply.

The power supply includes an error amplifier 5, which is different from the foregoing error amplifier 3 or 4. The error amplifier 5 includes a capacitor C2 as with the error amplifier 4. However, the error amplifier 5 differs from the error amplifier 4 in that the terminals of the capacitor C2 are connected to the base of the transistor Q7 and the output terminal OUT, respectively.

In the error amplifier 5, by providing the capacitor C2 between the base of the transistor Q7 and the output terminal OUT, a change in control voltage Vc at the output terminal OUT is more quickly transmitted to the transistor Q7 via the capacitor C2, turning on the transistor Q7 more quickly. This enables the phase compensation operation of the phase compensation circuit to more quickly respond to output oscillation, making it possible to prevent output oscillation more reliably. As a result, fast response is realized in the error amplifier 5.

Figure 4:
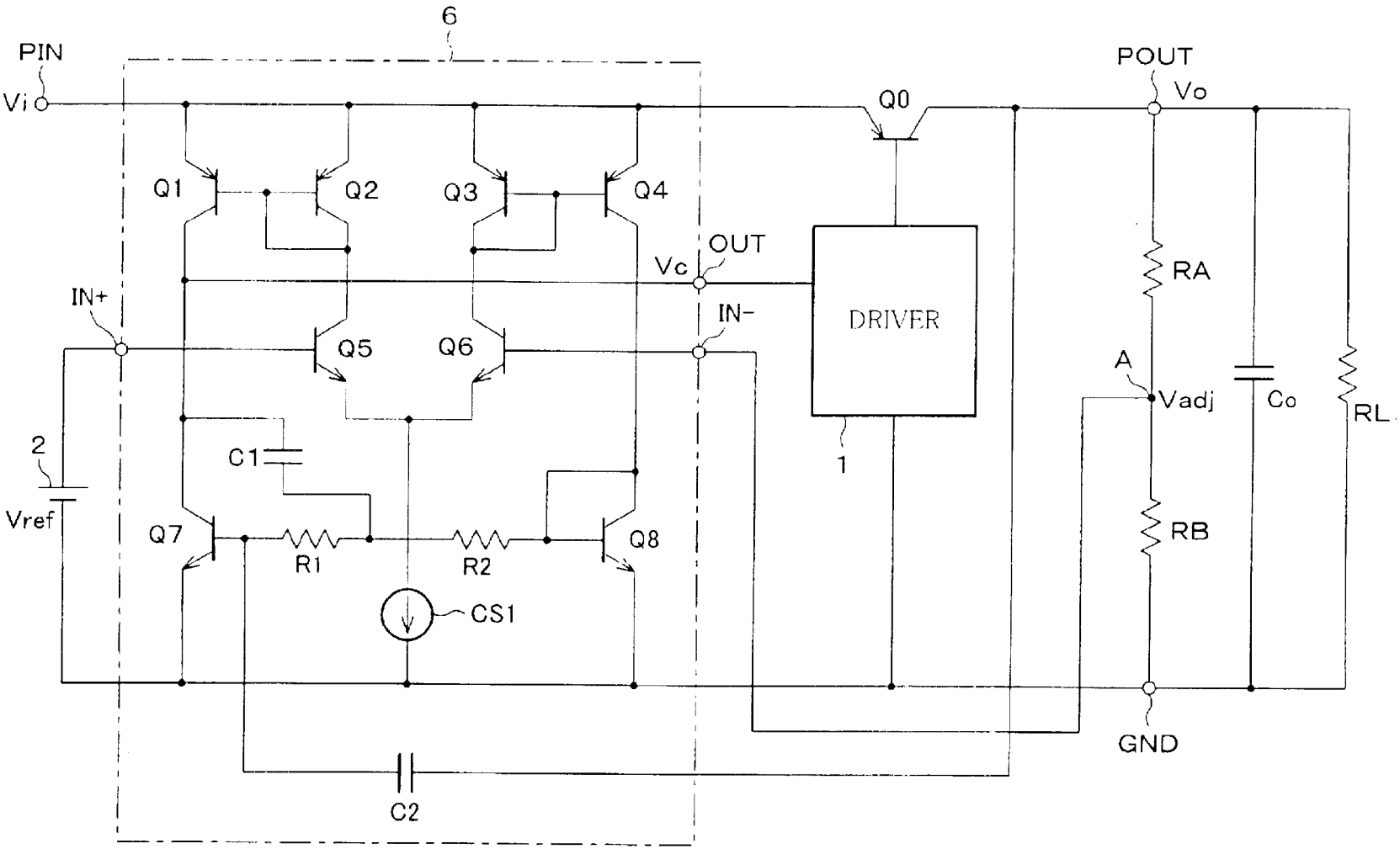
FIG. 4 is a circuit diagram representing a schematic structure of a fourth DC regulated power supply according to the embodiment of the present invention.

The following describes a fourth power supply according to the present embodiment. FIG. 4 shows a schematic structure of the power supply.

The power supply includes an error amplifier 6, which differs from any of the foregoing error amplifiers 3 through 5. The error amplifier 6 includes a capacitor C2 as with the error amplifier 4. However, the error amplifier 6 differs from the error amplifier 4 in that the terminals of the capacitor C2 are connected to the base of the transistor Q7 and the output terminal POUT of the power supply, respectively.

In the error amplifier 6, by providing the capacitor C2 between the base of the transistor Q7 and the output terminal POUT, a change in output voltage Vo at the output terminal POUT is more quickly transmitted to the transistor Q7 via the capacitor C2, turning on the transistor Q7 more quickly. This enables the phase compensation operation of the phase compensation circuit to more quickly respond to an abrupt change in output voltage Vo than the second power supply, thereby preventing output oscillation more reliably. As a result, even faster response is realized in the error amplifier 6.

Figure 5:
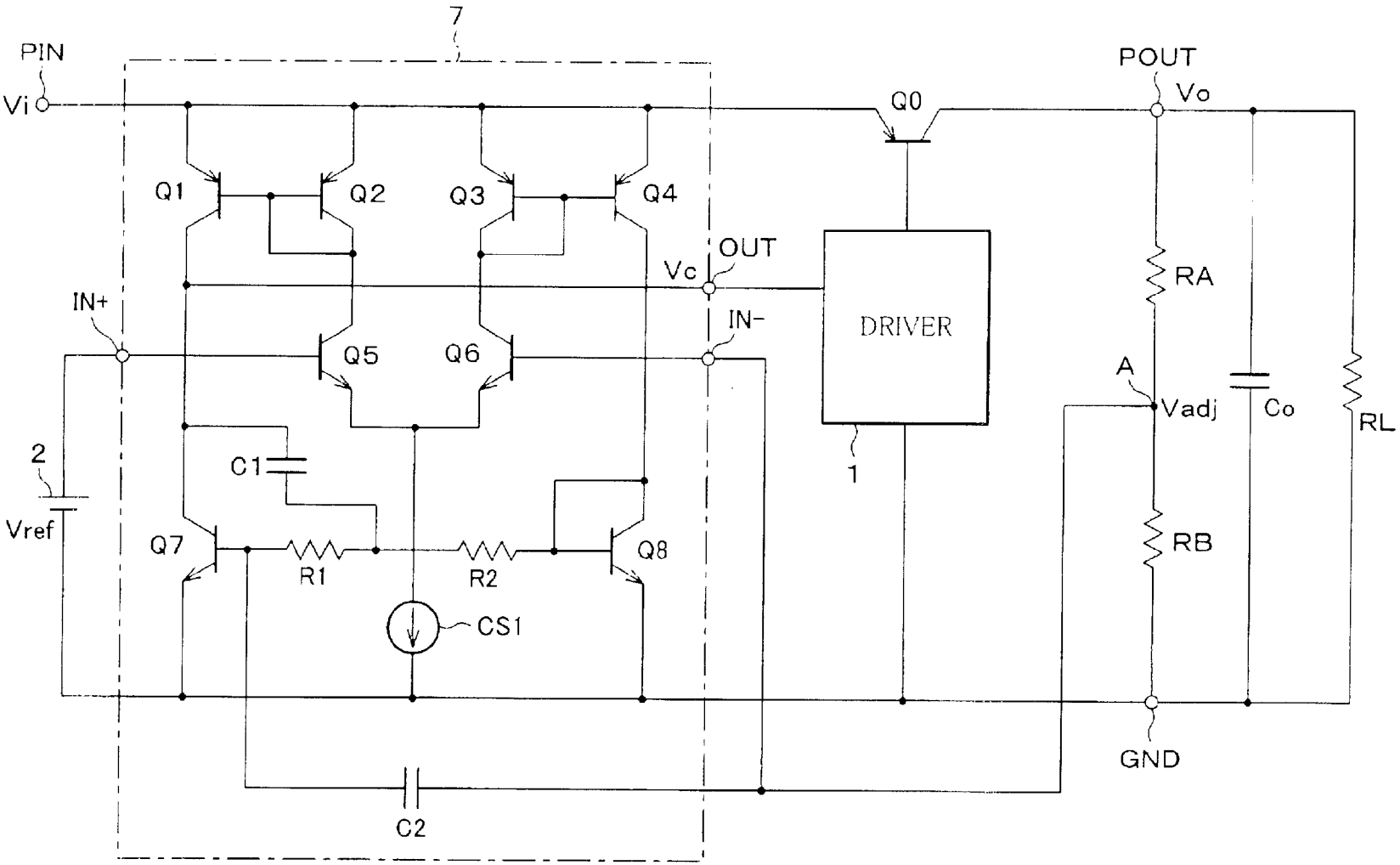
FIG. 5 is a circuit diagram representing a schematic structure of a fifth DC regulated power supply according to the embodiment of the present invention.
Figure 6:
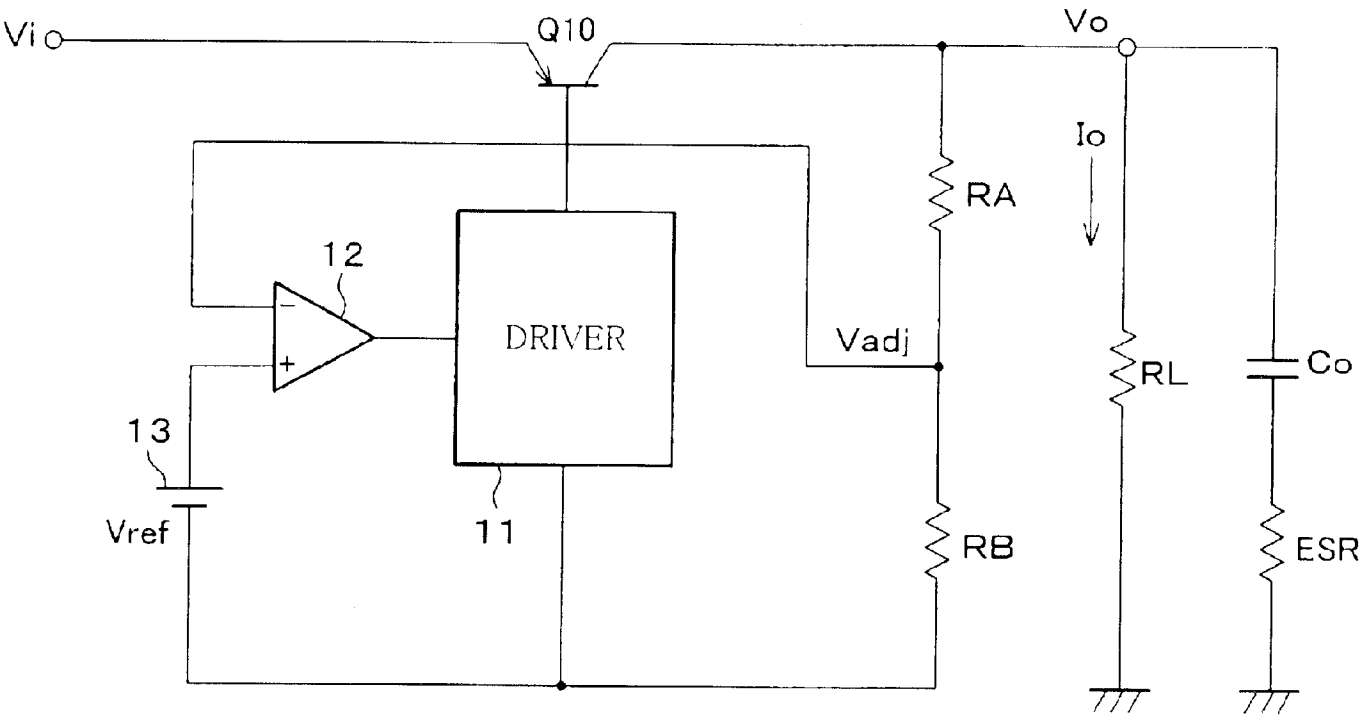
FIG. 6 (PRIOR ART)
FIG. 6 is a circuit diagram representing a schematic structure of a conventional DC regulated power supply.

The following describes a fifth power supply according to the present embodiment. FIG. 5 shows a schematic structure of the power supply.

The power supply includes an error amplifier 7, which differs from any of the foregoing error amplifiers 3 through 6. The error amplifier 7 differs from the error amplifier 6 in that the terminals of the capacitors C2 are connected to the base of the transistor 7 and the junction A of the voltage dividing resistors RA and RB, respectively.

In the error amplifier 7, by providing the capacitor C2 between the base of the transistor Q7 and the junction A, a change in feedback voltage Vadj at the junction A is more quickly transmitted to the transistor Q7 via the capacitor C2, turning on the transistor Q7 more quickly. This enables the phase compensation operation of the phase compensation circuit to more quickly respond to an abrupt change in output voltage Vo than the second power supply, thereby preventing output oscillation more reliably. As a result, even faster response is realized in the error amplifier 7.

The error amplifier 7 also differs from the error amplifier 6 in that the feedback voltage Vadj applied to the capacitor C2 is lower than the output voltage Vo. Among various types of ceramic capacitors, the chip-stacked ceramic capacitor incorporating a semiconductor junction has a property that the capacitance decreases with increase in applied voltage. Thus, when the capacitor C2 is a ceramic capacitor, the error amplifier 7 can increase the capacitance of the capacitor C2 more than the error amplifier 6 can. This enables the error amplifier 7 to respond faster than the error amplifier 6.

Preferably, the capacitors C2 of the fourth and fifth power supplies are of a type that varies its capacitance according to the applied voltage, i.e., the output voltage Vo. For example, the capacitor C2 may be a chip-stacked ceramic capacitor incorporating a semiconductor junction. With such capacitor C2, when the output voltage Vo is higher than a steady level, any increase in applied voltage to the capacitor C2 brings about a proportional decrease in the capacitance of the capacitor C2.

In the DC regulated power supply, the feedback amount from the output generally decreases as the output voltage increases. In this case, output oscillation becomes less likely. Conversely, the feedback amount from the output increases as the output voltage decreases. In this case, output oscillation becomes more likely. Thus, with the capacitor C2 that reduces its capacitance with increase in output voltage Vo, an output phase delay can be optimally compensated for according to the value of output voltage Vo, because in this case the capacitance of the capacitor C2 is essentially decided by the extent of output phase delay.

As described, each of the error amplifiers 3 through 7 of the present embodiment is an amplifier circuit that includes: a comparing and amplifying section that compares a target voltage and a reference voltage and amplifies a difference of the target voltage and the reference voltage; and a phase compensator that compensates for a shift of input and output phases, the phase compensator including two resistors and a capacitor, the two resistors being serially connected between bases of two sub transistors that flow the same current as that in a differential transistor pair made up of two transistors, the capacitor being connected between the collector of the sub transistor disposed on the output terminal side of the amplifier circuit and a junction of the resistors.

With this configuration, the effect of phase compensation can be made weaker by reducing the value of a phase compensation constant, which is determined by the product of capacitance and resistance of the capacitor and resistor of the low-pass filter realized by the resistor and capacitor connected to the base of the other sub transistor of the sub transistor disposed on the output terminal side of the amplifier circuit. As a result, this makes it possible to carry out phase compensation without causing a spontaneous voltage drop of output voltage in response to an abrupt load fluctuation. The amplifier circuit is therefore able to prevent output oscillation and improve load response characteristic when used in the DC regulated power supply of an intermediate current type, even when the chip-stacked type ceramic capacitor is used as the output capacitor.

It is preferable in the amplifier circuit that the phase compensator includes a phase advancing capacitor that compensates for an output phase delay. This enables the amplifier circuit, when used as an error amplifier of the DC regulated power supply, to compensate for an output phase delay and prevent output oscillation caused by output phase delay.

It is preferable in the amplifier circuit that the phase advancing capacitor is connected in parallel to the two resistors. In this way, a change in target voltage is more quickly transmitted from the differential transistor pair via the phase advancing capacitor to the sub transistor, turning on the sub transistor more quickly. This enables the phase compensation operation of the phase compensator to more quickly respond to an abrupt change in target voltage.

It is preferable that the phase advancing capacitor is connected between the output terminal and the base of the sub transistor on the side of the output terminal. In this way, a voltage change at the output terminal is more quickly transmitted to the sub transistor via the phase advancing capacitor, turning on the sub transistor more quickly. This enables the phase compensation operation to even more quickly respond to an abrupt change in target voltage. As a result, even faster response can be realized in the amplifier circuit.

In a power supply of the present embodiment including the error amplifier that controls the output voltage according to a difference of a feedback voltage, which is a feedback output voltage of the output transistor, and a predetermined voltage, the error amplifier is preferably the amplifier circuit with the phase advancing capacitor, and the phase advancing capacitor is preferably connected between a generating point of the output voltage and the base of the sub transistor on the output terminal side.

With this configuration, a change in output voltage is more quickly transmitted to the sub transistor via the phase advancing capacitor. This enables the phase compensation operation to more quickly respond to an abrupt change in output voltage, as opposed to capturing a voltage change at the output terminal of the amplifier circuit in the power supply. As a result, even faster response can be realized in the amplifier circuit.

In another power supply of the present embodiment including the error amplifier that controls the output voltage according to a difference of a feedback voltage, which is a feedback output voltage of the output transistor, and a reference voltage, the error amplifier is preferably the amplifier circuit with the phase advancing capacitor, and the phase advancing capacitor is preferably connected between a generating point of the feedback voltage and the base of the sub transistor on the output terminal side.

With this configuration, a change in output voltage is more quickly transmitted to the sub transistor via the phase advancing capacitor. This enables the phase compensation operation to more quickly respond to an abrupt change in output voltage, as opposed to capturing a voltage change at the output terminal of the amplifier circuit in the power supply. Further, since the feedback voltage is generally produced by dividing the output voltage through resistors or other circuit elements, the voltage applied to the phase advancing capacitor is lower than the output voltage. Thus, if the phase advancing capacitor is a ceramic capacitor with such a property that the capacitance decreases with increase in applied voltage, high response can be maintained even for a small voltage in the power supply. As a result, even faster response can be realized in the amplifier circuit.

It is preferable in the foregoing power supplies that the phase advancing capacitor is a capacitor that decreases its capacitance with increase in applied voltage. In this case, an increase in applied voltage to the phase advancing capacitor with increase in output voltage causes the feedback amount from the output to increase and the output oscillation becomes more likely. In addition, the capacitance of the phase advancing capacitor decreases. That is, the capacitance of the phase advancing capacitor is decided according to the extent of output phase delay. It is therefore possible to optimally compensate for an output phase delay according to a value of the output voltage.

In a power supply including the error amplifier that controls the output voltage according to the difference of a feedback voltage and a reference voltage, the error amplifier is preferably an amplifier circuit that is not provided with the phase advancing amplifier. With this amplifier circuit, a power supply can be provided that can prevent output oscillation and improve load response characteristic at the same time.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An amplifier circuit comprising:

a comparing and amplifying section that compares a target voltage and a reference voltage and amplifies a difference of the target voltage and the reference voltage; and a phase compensator that compensates for a shift of input and output phases, the phase compensator including two resistors and a capacitor, the two resistors being serially connected between bases of two sub transistors that flow the same current as that in a differential transistor pair comprising two transistors, the capacitor having a terminal connected to an output terminal of the amplifier circuit, and the capacitor having a terminal connected via one of the two resistors to the base of one of the two sub transistors receiving an amplifier output voltage outputted from the output terminal.

2. The amplifier circuit as set forth in claim 1, wherein the phase compensator includes a phase advancing capacitor that compensates for an output phase delay.

3. The amplifier circuit as set forth in claim 2, wherein the phase advancing capacitor is connected in parallel to the two resistors.

4. The amplifier circuit as set forth in claim 3, wherein the phase advancing capacitor is connected between the output terminal and the base of one of the two sub transistors on a side of the output terminal.

5. A power supply comprising:

an output transistor; and an error amplifier that controls an output voltage according to a difference of a feedback voltage and a reference voltage, the feedback voltage being a feedback output voltage of the output transistor, the error amplifier including:

a comparing and amplifying section that compares a target voltage and a reference voltage and amplifies a difference of the target voltage and the reference voltage; and a phase compensator that compensates for a shift of input and output phases, the phase compensator including two resistors and a capacitor, the two resistors being serially connected between bases of two sub transistors that flow the same current as that in a differential transistor pair comprising two transistors, the capacitor having a terminal connected to an output terminal of the amplifier circuit, and the capacitor having a terminal connected via one of the two resistors to the base of one of the two sub transistors receiving an amplifier output voltage outputted from the output terminal.

6. The power supply as set forth in claim 5, wherein the phase compensator further includes a phase advancing capacitor that compensates for an output phase delay.

7. The power supply as set forth in claim 6, wherein the phase advancing capacitor is connected between a generating point of the output voltage and the base of one of the two sub transistors on a side of the output terminal.

8. The power supply as set forth in claim 7, wherein the phase advancing capacitor is a capacitor that decreases its capacitance with increase in applied voltage.

9. The power supply as set forth in claim 8, wherein the phase advancing capacitor is a chip-stacked ceramic capacitor incorporating a semiconductor junction.

10. The power supply as set forth in claim 6, wherein the phase advancing capacitor is connected between a generating point of the feedback voltage and the base of one of the two sub transistors on a side of the output terminal.

11. The power supply as set forth in claim 10, wherein the phase advancing capacitor is a capacitor that decreases its capacitance with increase in applied voltage.

12. The power supply as set forth in claim 11, wherein the phase advancing capacitor is a chip-stacked ceramic capacitor incorporating a semiconductor junction.

13. The power supply as set forth in claim 6, wherein the phase advancing capacitor is connected in parallel to the two resistors.

14. The power supply as set forth in claim 6, wherein the phase advancing capacitor is connected between the output terminal and the base of one of the two sub transistors on a side of the output terminal.

* * * * *